US005372917A

United States Patent [19]

Tsuchida et al.

[11] Patent Number: 5,372,917

[45] Date of Patent: Dec. 13, 1994

[54] RECORDING MATERIAL

[75] Inventors: Tetsuo Tsuchida, Takarazuka; Tatsuya Meguro, Nishinomiya; Takaaki Kouro, Amagasaki; Haruo Omura, Sakai, all of Japan

[73] Assignee: Kanzaki Paper Manufacturing Co., Ltd., Tokyo, Japan

[21] Appl. No.: 82,947

[22] Filed: Jun. 29, 1993

[30] Foreign Application Priority Data

Jun. 30, 1992 [JP] Japan ..... 4-172860
Jun. 30, 1992 [JP] Japan ..... 4-172861

[51] Int. Cl.[5] ..... B41M 5/30; B41M 5/32; G03C 1/73

[52] U.S. Cl. ..... 430/343; 430/292; 430/334; 503/210; 503/217

[58] Field of Search ..... 430/945, 495, 292, 343, 430/338, 332; 503/217, 218, 210, 212

[56] References Cited

U.S. PATENT DOCUMENTS

| | | | |
|---|---|---|---|
| 3,409,457 | 11/1968 | Menzel et al. | 117/36.8 |
| 3,597,212 | 8/1971 | Webster et al. | 430/343 |
| 4,306,014 | 12/1981 | Kunikane et al. | 430/338 |
| 4,997,805 | 3/1991 | Junek et al. | 503/218 |
| 5,094,999 | 3/1992 | Tsuchida et al. | 503/216 |
| 5,096,872 | 3/1992 | Tsuchida et al. | 503/210 |
| 5,192,645 | 3/1993 | Boggs et al. | 430/338 |
| 5,276,001 | 1/1994 | Tsuchida et al. | 503/210 |

OTHER PUBLICATIONS

Chemical Abstracts 64:3734c (1966).
Chemical Abstracts 64:8362F (1966).

*Primary Examiner*—Charles L. Bowers, Jr.
*Assistant Examiner*—John A. McPherson
*Attorney, Agent, or Firm*—Nikaido, Marmelstein, Murray & Oram

[57] ABSTRACT

The present invention provides a recording material utilizing a reaction between a colorless or light-colored dye precursor and a color developer capable of forming a color upon coming into contact with the dye precursor, the recording material being characterized in that the material comprises at least one compound serving as the dye precursor and represented by the formula (1), and an acidic substance serving as the color developer

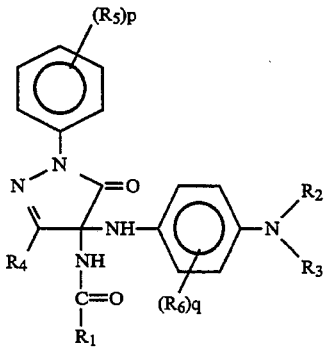

(1)

wherein $R_1$ to $R_6$, p and q are defined in the specification.

At least one selected from the group consisting of phenolic compounds of the formulae (10), (11) and (12) and phenolic resin having a partial structure of the formula (13) can be used, as required, to further improve the color forming properties and change the color of recorded images from reddish purple or purple to blue or dark blue.

8 Claims, No Drawings

RECORDING MATERIAL

RECORDING MATERIAL

The present invention relates to recording materials, and more particularly to recording materials which are excellent in color forming property, storage stability and preservability of images recorded thereon.

Various recording materials are known which utilize a color forming reaction between a colorless or light-colored dye precursor and an organic or inorganic color developer, and which include pressure sensitive recording materials, heat sensitive recording materials, electrothermal recording materials, etc. as typical examples.

The properties required of these recording materials include a satisfactory recording density, excellent preservability of recorded images under external ambient conditions involving high temperatures, high humidities, exposure to light and contact with chemicals and no color formation in the background area. However, recording materials still remain to be developed which completely fulfill these requirements.

Heat sensitive recording materials, for example, are used in various fields in diversified forms with remarkable progress in heat sensitive recording systems in recent years. These materials are used as recording media for thermal facsimile systems and thermal printers and are also in rapidly growing use for novel applications as labels for POS (Point of Sales) system and as recording materials for ATM (Auto Teller Machine) and handy type thermal printers. Nevertheless, conventional heat sensitive recording materials have the drawback of undergoing a color change or fading in the image area or fogging in the background area when preserved at high temperatures or high humidities, when brought into contact with plasticizers, solvents, oils or fats or when exposed to sunlight.

To overcome the above drawback, it has been proposed to form a protective layer of high polymer compounds over the heat sensitive recording layer, and such protective layers are already introduced into actual use, whereas fully satisfactory effects have yet to be achieved in any of heat resistance, moisture resistance, resistance to plasticizers, light resistance and resistance to chemicals. Because of the drawback, heat sensitive recording materials have found limited use at present, and it is strongly desired to overcome the drawback.

To improve the color forming system and thereby give heat sensitive recording materials higher preservability of recorded images, various recording materials have been investigated which utilize a chelate system, oxidation-reduction system, diazo coupling system or the like for an irreversible color forming reaction. Although satisfactory in image fastness, the chelate system is low in sensitivity and susceptible to coloration of the background due to metal compounds. The oxidation-reduction system permits gradual color formation in the background owing to oxidation with air. The diazo coupling system is unstable and low in storage stability and requires fixing process with a complex device. Although improved storage stability is available when the diazonium salt is enclosed in microcapsules and thereby separated from other materials, the system has problems in respect of color density and paper cost. Because of these drawbacks, none of the above systems have found wide use.

As one of the recording materials utilizing such an irreversible color forming reaction, U.S. Pat. No. 3,409,457 discloses a recording material wherein a pyrazolone-derived leuco compound is used as a color former. However, the leuco compound is used singly in the conventional recording material, which therefore remains to be improved in color forming properties for actual use.

The main object of the present invention is to provide a recording material having high practical value and which is especially excellent in color forming property, storage stability and recorded image preservability.

The above and other objects will become apparent from the following description.

The present invention provides a recording material utilizing a reaction between a colorless or light-colored dye precursor and a color developer capable of forming a color upon coming into contact with the dye precursor, the recording material being characterized in that the material comprises at least one compound serving as the dye precursor and represented by the formula (1), and an acidic substance serving as the color developer

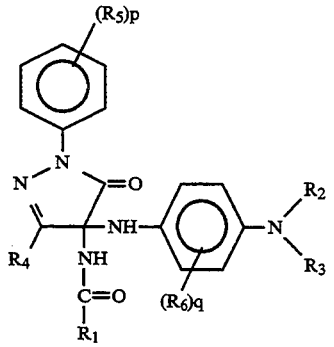

(1)

wherein $R_1$ is alkyl, alkoxyalkyl, aryl or aryl having a substituent, $R_2$ and $R_3$ are each alkyl, alkyl having a subsitituent, aryl or aryl having a substituent, $R_4$ is alkyl, alkyl having a substituent, aryl, aryl having a substituent, amino or amino having a substituent, $R_5$ and $R_6$ are each alkyl, alkoxyl or a halogen atom, p is 0 or an integer of 1 to 5, and q is 0 or an integer of 1 to 4.

The pyrazolone-derived leuco compound thus used in combination with the specific color developer affords a recording material which is excellent in color forming properties, and outstanding characteristics permitting the image area to remain free of color change or fading and rendering the blank background area free of fogging even when the material is stored in high-temperature or high-humidity environments or comes into contact with chemicals such as plasticizers, solvent, etc.

It is known that when intensely heated singly, the pyrazolone-derived leuco compound of the present invention undergoes a decomposition reaction wherein the acylamino group substituted in the 4-position of the pyrazolone ring becomes removed along with the hydrogen atom of the amino group adjacent thereto to form an azomethine dye. However, the above thermal decomposition reaction is slow in response under a normal recording condition and satisfactory recorded images are not obtained. We have found that the color forming reaction of such a leuco compound (dye precursor) can be remarkably promoted by the presence of an acidic substance and thereby the recorded image preservability is further enhanced, and have accomplished the present invention.

In the dye precursor represented by the formula (1), $R_1$ is alkyl, alkoxyalkyl, aryl or aryl having a substituent. The aryl is phenyl, naphthyl or an aromatic heterocyclic residue. Examples of substituents are alkyl, alkoxyl, halogen atoms, etc. Among these, $R_1$ is preferably $C_1 \sim C_4$ alkyl group or phenyl.

$R_2$ and $R_3$ are each alkyl, alkyl having a substituent, aryl or aryl having a substituent. Examples of substituents for alkyl are aryl, alkoxyl, hydroxyl, alkylsulfonylamino, etc. Examples of substituents for aryl are alkyl, alkoxyl, halogen atoms, etc. Among these, $R_2$ and $R_3$ are preferably each $C_1 \sim C_4$ alkyl group or $C_1 \sim C_4$ alkyl group substituted by $C_1 \sim C_4$ alkoxyl, hydroxyl or $C_1 \sim C_4$ alkylsulfonylamino.

$R_4$ is alkyl, alkyl having a substituent, aryl, aryl having a substituent, amino or amino having a substituent. Examples of substituents for alkyl are aryl, alkoxyl, aryloxy, acylamino, N-substituted carbamoyl, N-substituted sulfamoyl, etc. Examples of substituents for aryl are alkyl, alkoxyl, aryloxy, halogen atoms, arylalkyl, arylalkoxyl, aryloxyalkoxyl, arylsulfonylalkoxyl, acylamino, alkylsulfonylamino, arylsulfonylamino, N-substituted carbamoyl, N-substituted sulfamoyl, etc.

Examples of substituents for amino are alkyl, aryl, alkylcarbonyl, arylcarbonyl, alkylsulfonyl, arylsulfonyl, etc. The alkyl groups and aryl groups as substituents may further have a substituent. Examples of substituents for the alkyl groups are aryl, alkoxyl, aryloxy, acylamino, N-substituted carbamoyl, N-substituted sulfamoyl, etc. Examples of substituents for the aryl groups are alkyl, alkoxyl, aryloxy, halogen atoms, arylalkyl, arylalkoxyl, aryloxyalkoxyl, arylsulfonylalkoxyl, acylamino, alkylsulfonylamino, arylsulfonylamino, N-substituted carbamoyl, N-substituted sulfamoyl, etc.

Among these in view of resistance to light and resistance to chemicals, $R_4$ is arylcarbonylamino of the formula (4), (5) or (6) or alkylcarbonylamino of the formula (7), (8) or (9). More preferable is arylcarbonylamino of the formula (4) or (5), and most preferable is arylcarbonylamino of the formula (4).

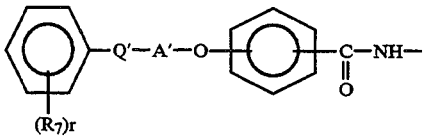

(4)

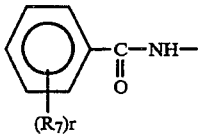

(5)

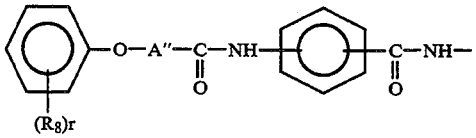

(6)

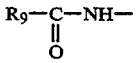

(7)

-continued

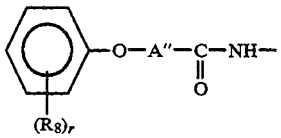

(8)

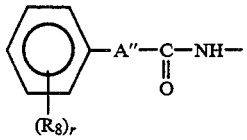

(9)

wherein $R_7$ is $C_1 \sim C_4$ alkyl, $C_1 \sim C_4$ alkoxyl or halogen atom, $R_8$ is $C_1 \sim C_5$ alkyl, $C_1 \sim C_4$ alkoxyl or halogen atom, $R_9$ is $C_1 \sim C_{25}$ alkyl, Q' is an ether linkage or sulfonyl linkage, A' is branched-chain or straight-chain $C_2 \sim C_6$ alkylene, A'' is branched-chain or straight-chain $C_1 \sim C_6$ alkylene, r is 0 or an integer of 1 to 5.

In the above dye precursors of the formula (1), $R_5$ and $R_6$ are each alkyl, alkoxyl or halogen atom. $R_5$ is preferably $C_1 \sim C_4$ alkyl, $C_1 \sim C_4$ alkoxyl or halogen atom, and $R_6$ is preferably $C_1 \sim C_4$ alkyl or $C_1 \sim C_4$ alkoxyl. p is 0 or an integer of 1 to 5, and preferably 0 or an integer of 1 to 3. q is 0 or an integer of 1 to 4, and preferably 0 or 1.

The followings are examples of the compounds represented by the formula (1). 1-Phenyl-3-methyl-4-(4-N,N-diethylaminophenylamino)-4-acetylamino-5-pyrazolone, 1-phenyl-3-methyl-4-(4-N,N-dimethylaminophenylamino)-4-acetylamino-5-pyrazolone, 1-(2,4,6-trichlorophenyl)-3-methyl-4-(4-N,N-diethylaminophenylamino)-4-acetylamino-5-pyrazolone, 1-phenyl-3-methyl-4-(4-N,N-dimethylaminophenylamino)-4-benzoylamino-5-pyrazolone, 1-phenyl-3-benzoylamino-(4-N,N-diethylaminophenylamino)-4-benzoylamino-5-pyrazolone, 1-phenyl-3-phenyl-4-4-N,N-diethylaminophenylamino)-4-acetylamino-5-pyrazolone, 1-(2,4,6-trichlorophenyl)-3-phenyl-4-(4-N,N-diethylaminophenylamino)-4-acetylamino-5-pyrazolone, 1-phenyl-3-benzoylamino-4-(4-N,N-diethylaminophenylamino)-4-acetylamino-5-pyrazolone, 1-(2,4,6-trichlorophenyl)-3-benzoylamino-4-(4-N,N-diethylaminophenylamino)-4-acetylamino-5-pyrazolone, 1-phenyl-3-benzoylamino-4-(4-N,N-diethylamino-2-methylphenylamino)-4-acetylamino-5-pyrazolone, 1-phenyl-3-benzoylamino-4-(4-N,N-diethylamino-2-methoxyphenylamino)-4-acetylamino-5-pyrazolone, 1-phenyl-3-acetylamino-4-(4-N,N-diethylaminophenylamino)-4-acetylamino-5-pyrazolone, 1-phenyl-3-stearoylamino-4-(4-N,N-diethylaminophenylamino)-4-acetylamino-5-pyrazolone, 1-phenyl-3-phenylacetylamino-4-(4-N,N-diethylaminophenylamino)-4-acetylamino-5-pyrazolone, 1-phenyl-3-(3,4,5-trichlorophenylacetylamino)-4-(4-N,N-diethylaminophenylamino)-4-acetylamino-5-pyrazolone, 1-phenyl-3-(3,4,5-trimethylphenylacetylamino)-4-(4-N,N-diethylaminophenylamino)-4-acetylamino-5-pyrazolone, 1-phenyl-3-phenoxyacetylamino-4-(4-N,N-diethylaminophenylamino)-4-acetylamino-5-pyrazolone, 1-phenyl-3-(3,4,5-trichlorophenoxyacetylamino)-4-(4-N,N-diethylaminophenylamino)-4-acetylamino-5-pyrazolone, 1-phenyl-3-(3,4,5-trimethylphenoxyacetylamino)-4-(4-N,N-diethylaminophenylamino)-4-acetylamino-5-pyrazolone, 1-phenyl-3-benzoylamino-4-[4-N-ethyl-N-(2-hydroxyethyl)amino-2-methylphenylamino]-4-acetylamino-5-pyrazolone, 1-phenyl-3-benzoylamino-4-[4-N-ethyl-N-(2-methylsulfonylamino-ethyl)amino-2-methylphenylamino]-4-acetylamino-5-pyrazolone, 1-phenyl-3-benzoylamino-4-(4-N,N-dimethylaminophenylamino)-4-acetylamino-5-pyrazolone, 1-phenyl-3-benzoylamino-4-[4-N-ethyl-N-(2-hydroxyethyl)aminophenylamino]-4-acetylamino-5-pyrazolone, 1-phenyl-3-benzoylamino-4-[4-N-ethyl-N-(2-methoxyethyl)aminophenylamino]-4-acetylamino-5-pyrazolone, 1-(4-chlorophenyl)-3-benzoylamino-4-(4-N,N-diethylamino-2-methylphenylamino)-4-acetylamino-5-pyrazolone, 1-(4-chlorophenyl)-3-benzoylamino-4-(4-N,N-diethylaminophenylamino)-4-acetylamino-5-pyrazolone, 1-(2-chlorophenyl)-3-benzoylamino-4-(4-N,N-diethylaminophenylamino)-4-acetylamino-5-pyrazolone, 1-(2,4-dichlorophenyl)-3-benzoylamino-4-(4-N,N-diethylaminophenylamino)-4-acetylamino-5-pyrazolone, 1-(4-methoxyphenyl)-3-benzoylamino-4-(4-N,N-diethylaminophenylamino)-4-acetylamino-5-pyrazolone, 1-p-tolyl-3-benzoylamino-4-(4-N,N-diethylaminophenylamino)-4-acetylamino-5-pyrazolone, 1-phenyl-3-(2-chlorobenzoylamino)-4-(4-N,N-diethylaminophenylamino)-4-acetylamino-5-pyrazolone, 1-phenyl-3-(4-chlorobenzoylamino)-4-(4-N,N-diethylaminophenylamino)-4-acetylamino-5-pyrazolone, 1-phenyl-3-(3,4,5-trichlorobenzoylamino)-4-(4-N,N-diethylaminophenylamino)-4-acetylamino-5-pyrazolone, 1-phenyl-3-(3,4,5-trimethylbenzoylamino)-4-(4-N,N-diethylaminophenylamino)-4-acetylamino-5-pyrazolone, 1-phenyl-3-(4-methoxybenzoylamino)-4-(4-N,N-diethylaminophenylamino)-4-acetylamino-5-pyrazolone, 1-phenyl-3-(4-methylbenzoylamino)-4-(4-N,N-diethylaminophenylamino)-4-acetylamino-5-pyrazolone, 1-phenyl-3-[3-(2,4-di-tert-pentylphenoxyacetylamino)-benzoylamino]-4-(4-N,N-diethylaminophenylamino)-4-acetylamino-5-pyrazolone, 1-(2,4,6-trichlorophenyl)-3-[3-(2,4-di-tertpentylphenoxyacetylamino)benzoylamino]-4-(4-N,N-diethylaminophenylamino)-4-acetylamino-5-pyrazolone, 1-phenyl-3-[3-(phenoxyacetylamino)benzoylamino]-4-(4-N,N-diethylaminophenylamino)-4-acetylamino-5-pyrazolone, 1-phenyl-3-[3-(phenylsulfonylamino)benzoylamino]-4-(4-N,N-diethylaminophenylamino)-4-acetylamino-5-pyrazolone, 1-phenyl-3-[3-(N-phenylsulfamoyl)benzoylamino]-4-(4-N,N-diethylaminophenylamino)-4-acetylamino-5-pyrazolone, 1-phenyl-3-[3-(N-phenylcarbamoyl)benzoylamino]-4-(4-N,N-diethylaminophenylamino)-4-acetylamino-5-pyrazolone, 1-phenyl-3-[4-(3-p-tolylsulfonylpropoxy)benzoylamino]-4-(4-N,N-diethylaminophenylamino)-4-acetylamino-5-pyrazolone, 1-phenyl-3-[3-(3-p-tolylsulfonylpropoxy)benzoylamino]-4-(4-N,N-diethylaminophenylamino)-4-acetylamino-5-pyrazolone, 1-phenyl-3-[4-(3-p-tolylsulfonylpropoxy)benzoylamino]-4-[4-N-ethyl-N-(2-hydroxyethyl)aminophenylamino]-4-acetylamino-5-pyrazolone, 1-phenyl-3-[4-(3-p-methoxyphenylsulfonylpropoxy)benzoylamino]-4-(4-N,N-diethylaminophenylamino)-4-acetylamino-5-pyrazolone, 1-phenyl-3-[4-(3-phenylsulfonylpropoxy)benzoylamino]-4-(4-N,N-diethylaminophenylamino)-4-acetylamino-5-pyrazolone, 1-phenyl-3-[4-(3-p-chlorophenylsulfonylpropoxy)benzoylamino]-4-(4-N,N-diethylaminophenylamino)-4-acetylamino-5-pyrazolone, 1-phenyl-3-[4- (4-p-tolylsulfonylbutoxy)-benzoylamino]-4-(4-N,N-diethylaminophenylamino)-4-acetylamino-5-pyrazolone, 1-phenyl-3-[4-(2-p-tolylsulfonylbutoxy)benzoylamino]-4-(4-N,N-diethylaminophenylamino)-4-acetylamino-5-pyrazolone, 1-phenyl-3-{4-[3-(3,4,5-trimethylphenylsulfonyl)propoxy]benzoylamino}-4-(4-N,N-diethylaminophenylamino)-4-acetylamino-5-pyrazolone, 1-phenyl-3-{4-[3-(3,4,5-trichlorophenylsulfonyl)propoxy]benzoylamino}-4-(4-N,N-diethylaminophenylamino)-4-acetylamino-5-pyrazolone, 1-phenyl-3-[4-(3-phenoxypropoxy)benzoylamino]-4-(4-N,N-diethylaminophenylamino)-4-acetylamino-5-pyrazolone, 1-phenyl-3-[4-(2-p-methoxyphenoxyethoxy)benzoylamino]-4-(4-N,N-diethylaminophenylamino)-4-acetylamino-5-pyrazolone, 1-phenyl-3-[4-(2-phenoxyethoxy)benzoylamino]-4-(4-N,N-diethylaminophenylamino)-4-acetylamino-5-pyrazolone, 1-phenyl-3-anilino-4-(4-N,N-diethylaminophenylamino)-4-acetylamino-5-pyrazolone, 1-phenyl-3-(2-chloroanilino)-4-(4-N,N-diethylaminophenylamino)-4-acetylamino-5-pyrazolone, 1-phenyl-3-(4-methoxyanilino)-4-(4-N,N-diethylaminophenylamino)-4-acetylamino-5-pyrazolone, 1-phenyl-3-p-toluidino-4-(4-N,N-diethylaminophenylamino)-4-acetylamino-5-pyrazolone, 1-(2,4,6-trichlorophenyl)-3-anilino-4-(4-N,N-diethylaminophenylamino)-4-acetylamino-5-pyrazolone, 1-phenyl-3-(2-chloroanilino)-4-(4-N,N-diethylamino-2-methylphenylamino)-4-acetylamino-5-pyrazolone, etc.

The compound of the formula (1) is not limited to those above, and as required at least two of them are used. The color of recorded images to be produced by these dye precursors is generally reddish purple to purple although the color slightly differs with the substituents of the compound and the kind of acidic substance to be used as the color developer.

The acidic substance to be used as the color developer for the above-specified dye precursor is a substance which acts as a Bronsted acid or Lewis acid. Examples of useful acidic substances are organic acidic substances such as aliphatic or aromatic carboxylic acid and their derivatives and phenol and its derivatives, polyvalent metal salts of such acids, metal complex compounds, such as complexes of zinc thiocyanate with organic base ligands, and inorganic acidic substances such as terra alba.

In the present invention, the followings are examples of acidic substances.

Acidic clay, activated clay, attapulgite, bentonite, colloidal silica, aluminum silicate, magnesium silicate, zinc silicate, tin silicate, calcined kaolin, talc and like inorganic acidic substances; 4,4'-isopropylidenediphenol, 4,4'-isopropylidene(2-chlorophenol), 4,4'-isopropylidenebis-(2,6-dichlorophenol), 4,4'-isopropylidene(2,6-dibromophenol), 4,4'-isopropylidenebis(2-methylphenol), 4,4'-isopropylidenebis(2,6-dimethylphenol), 4,4'-isopropylidenebis(2-tertbutylphenol), 4,4'-sec-butylidenediphenol, 2,2'-bis(4-hydroxyphenyl)-4-methylpentane, 4,4'-cyclohexylidenebisphenol, 4,4'-cyclohexylidenebis(2-methylphenol), 4-tert-butylphenol, 4-phenylphenol, 2,2'-methylenebis(4-methyl-6-tertbutylphenol), methyl bis(4-hydroxyphenyl)acetate, ethyl bis(4-hydroxyphenyl)acetate, benzyl bis(4-hydroxyphenyl)acetate, 4,4'-(p-phenylenediisopropylidene)diphenol, 4,4'-(m-phenylenediisopropylidene)diphenol, 4-hydroxydiphenylsulfone, 4,4'-dihydroxydiphenylsulfone, 2,4'-dihydroxydiphenylsulfone, 4-hydroxy-4'-methyldiphenylsulfone, 4-hydroxy-4'-isopropoxydiphenylsulfone, 4-hydroxy-3',4'-tetramethylenediphenylsulfone, 4-hydroxy-3',4'-trimethylenediphenylsulfone, 3,3'-diallyl-4,4'-dihydroxydiphenylsulfone, 2-phenoxyethyl bis(4-hydroxyphenyl)acetate, p-hydroxy-N-(2-phenoxyethyl)benzenesulfonamide, dimethyl 4-hydroxyphthalate, 4-acetylphenol, 4-tert-octylphenol, 4,4'-dihydroxydiphenylmethane, hydroquinone, 4,4'-(1,3-dimethylbutylidene)bisphenol, 2,2-bis(4-hydroxyphenyl)-4-methylpentane, 4-hydroxy-4'-methoxydiphenylsulfone, 4-hydroxybenzophenone,4,4'-dihydroxybenzophenone, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, p-chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, p-phenylphenol-formalin resin, p-butylphenol-acetylene resin, novolak phenol resin, phenolic polymer and like phenolic compounds; oxalic acid, maleic acid, tartaric acid, citric acid, succinic acid, stearic acid, phenylacetic acid, phenoxyacetic acid and like aliphatic carboxylic acids; benzoic acid, 4-tert-butylbenzoic acid, 4-trifluoromethyl-benzoic acid, 4-chlorobenzoic acid, 4-nitrobenzoic acid, 3-sec-butyl-4-hydroxybenzoic acid, 3-cyclohexyl-4-hydroxybenzoic acid, 3,5-dimethyl-4-hydroxybenzoic acid, α-naphthoic acid, β-naphthoic acid, phthalic acid, isophthalic acid, terephthalic acid, monomethyl terephthalate, gallic acid, salicylic acid, 3-isopropylsalicylic acid, 3-phenylsalicylic acid, 3-cyclohexylsalicylic acid, 3,5-di-tert-butylsalicylic acid, 3-methyl-5-benzylsalicylic acid, 4-pentyloxysalicylic acid, 3-phenyl-5-(α,α-dimethylbenzyl)salicylic acid, 3,5-di-(α-methylbenzyl)salicylic acid, 2-hydroxy-1-benzyl-3-naphthoic acid, 3-dodecylsalicylic acid, 3-nonylsalicylic acid, 3-benzylsalicylic acid, 3-(α-methylbenzyl)salicylic acid, 3-chloro-5-(α-methylbenzyl)salicylic acid, 3,5-di-(α,α-dimethylbenzyl)salicylic acid, 3-(α,α-dimethylbenzyl)-5-methylsalicylic acid, 4-(3-phenylsulfonylpropoxy)salicylic acid, 5-(3-phenylsulfonylpropoxy) salicylic acid, 4-(4-phenylsulfonylbutoxy)salicylic acid, 4-(5-phenylsulfonyl-3-oxa-pentyloxy)salicylic acid, 4-(3-p-tolylsulfonylpropoxy)salicylic acid, 5-(3-p-tolylsulfonylpropoxy)salicylic acid, 4-(6-p-tolylsulfonylhexyloxy)salicylic acid, 4-(5-p-tolylsulfonyl-3-oxa-pentyloxy) salicylic acid, 4-(3-p-methoxyphenylsulfonylpropoxy)salicylic acid, 4-(3-p-chlorophenylsulfonylpropoxy)salicylic acid, 4-(2-phenoxyethoxy)salicylic acid, 4-(2-p-methoxyphenoxyethoxy)salicylic acid, 5-(2-p-methoxyphenoxy) salicylic acid, 4-(5-p-methoxyphenoxy-3-oxa-pentyloxy)salicylic acid, 4-(5-phenoxy-3-oxa-pentyloxy)salicylic acid, 4-(3-p-methoxypropoxy)salicylic acid, 4-[p-(2-phenoxyethoxy)cumyl]salicylic acid, 5-[p-(2-phenoxyethoxy)cumyl]salicylic acid, 5-[p-(5-phenoxy-3-oxapentyloxy)cumyl]salicylic acid, 5-[p-(2-methoxyphenoxyethoxy)cumyl]salicylic acid, 5-[p-(4-p-tolylsulfonylpropoxy)cumyl]salicylic acid, 5-[p-(3-phenylsulfonylpropoxy)cumyl]salicylic acid, 5-[p-(3-p-methoxyphenylsulfonylpropoxy)cumyl]salicylic acid and like aromatic carboxylic acids; salts of such phenolic compounds, aliphatic carboxylic acids or aromatic carboxylic acids with a polyvalent metal; metal complexes such as a complex of antipyrine and zinc thiocyanate; etc. The acidic substance is not limited to thereabove and as required at least two of them are used.

The polyvalent metal which forms a salt or complex is preferably a bivalent, trivalent or tetravalent metal, more preferably zinc, calcium, aluminum, magnesium, tin or iron.

Among the above acidic substances preferable is an aromatic carboxylic acid derivative or a polyvalent metal salt thereof which can afford a recording material having especially excellent color forming property. Particularly preferable is at least one of a salicylic acid derivative of the following formulae (2) and (3) or a polyvalent metal salt thereof which can provide a recording material having excellent chemical resistance.

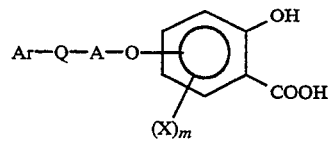

(2)

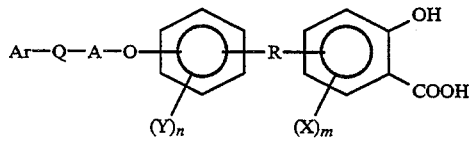

(3)

wherein Ar is phenyl, substituted phenyl, naphthyl, substituted naphthyl, aromatic heterocyclic group or substituted aromatic heterocyclic group, Q is an ether linkage or sulfonyl linkage, A is branched or straight-chain alkylene, branched or straight-chain alkylene having an ether linkage, ester linkage, amide linkage or unsaturated bond, cycloalkylene, cycloalkylene having an ether linkage, ester linkage or amide linkage, aralkylene, aralkylene having an ether linkage, ester linkage or amide linkage, or arylene, R is branched or unbranched alkylene, X is a hydrogen atom, alkyl, cycloalkyl, alkenyl, aralkyl, aryl, alkoxyl, aryloxy, nitro or halogen atom, Y is a hydrogen atom, alkyl, alkenyl, aralkyl or halogen atom, m is an integer of 1 to 3, and n is an integer of 1 to 4.

Incidentally, some substituents are expressed by the same symbol in the formulae (2) and (3). This is merely intended to avoid repeated description of the substituents.

In the salicylic acid derivatives represented by the formula (2) or (3), Ar is phenyl, phenyl having a substituent, naphthyl, naphthyl having a substituent, an aromatic heterocyclic group or aromatic heterocyclic group having a substituent. Preferable among these are phenyl and phenyl having a substituent. Preferred substituents for phenyl are alkyl, cycloalkyl, alkenyl, aryl, aralkyl, alkoxyl, alkylthio, aryloxy, aralkyloxy, arylcarbonyl, aryloxycarbonyl, alkoxycarbonyl, alkylcarbonyl, alkylcarbonyloxy, nitro, hydroxyl and halogen atoms. More preferable among these are $C_1 \sim C_6$ alkyl, $C_1 \sim C_6$ alkoxyl, $C_7 \sim C_{10}$ aralkyl, $C_7 \sim C_{10}$ aralkyloxy, chlorine atom, bromine atom and fluorine atom. The most preferable of these are $C_1 \sim C_4$ alkyl, $C_1 \sim C_4$ alkoxyl and chlorine atom.

Further in the salicylic acid derivatives represented by the formula (2) or (3), Q is an ether linkage or sulfonyl linkage. A is branched or straight-chain alkylene, branched or straight-chain alkylene having an ether linkage, ester linkage, amido linkage or unsaturated bond, cycloalkylene, cycloalkylene having an ether linkage, ester linkage or amido linkage, aralkylene, aralkylene having an ether linkage, ester linkage or amido linkage, or arylene. Among these, $C_1 \sim C_{12}$ alkylene and $C_1 \sim C_{12}$ alkylene having an ether linkage are more preferable, and $C_2 \sim C_6$ alkylene is most preferable.

In the formula (3), R is alkylene or branched alkylene, preferably $C_1 \sim C_{12}$ alkylene, more preferably $C_2 \sim C_6$ alkylene or branched $C_2 \sim C_6$ alkylene.

Further in the formula (2) or (3), X is a hydrogen atom, alkyl, cycloalkyl, alkenyl, aralkyl, aryl, alkoxyl, aryloxy, nitro or halogen atom. Preferable among these is a hydrogen atom, $C_1 \sim C_{20}$ alkyl, $C_5 \sim C_7$ cycloalkyl, $C_2 \sim C_6$ alkenyl, $C_7 \sim C_{10}$ aralkyl, $C_1 \sim C_{20}$ alkoxyl, phenyl, naphthyl, phenoxy, nitro or halogen atom. More preferable among these is a hydrogen atom, $C_1 \sim C_6$ alkyl, $C_7 \sim C_{10}$ aralkyl, $C_1 \sim C_6$ alkoxyl, phenyl, phenoxy, chlorine atom, bromine atom or fluorine atom. Especially, hydrogen atom is preferable. Y is a hydrogen atom, alkyl, alkenyl, aralkyl or halogen atom. More preferable among these is a hydrogen atom, $C_1 \sim C_6$ alkyl, $C_2 \sim C_6$ alkenyl, $C_7 \sim C_{10}$ aralkyl or halogen atom. Especially, hydrogen atom is preferable. m is an integer of 1 to 3, and n is an integer of 1 to 4.

Although the proportions of the above dye precursor and the color developer therefor, i.e., acidic substance are not limited specifically, it is generally desirable to use 50 to 700 parts by weight, more desirably 100 to 500 parts by weight, of the color developer per 100 parts by weight of the dye precursor.

Further when a metal compound is incorporated into the recording material along with the color developer, the recording material can be given more improved characteristics. The metal compound herein referred to is a compound of bivalent, trivalent or tetravatent metal. Examples of useful metal compounds are oxides, hydroxides, sulfides, halides, carbonates, phosphates, silicates, sulfates, nitrates, halogen complex salts or the like of metals such as zinc, magnesium, barium, calcium, aluminum, tin, titanium, nickel, cobalt, manganese and iron. Especially preferable among these are zinc compounds. More specific examples of useful metal compounds are zinc oxide, zinc hydroxide, zinc aluminate, zinc sulfide, zinc carbonate, zinc phosphate, zinc silicate, aluminum oxide, magnesium oxide, titanium oxide, aluminum hydroxide, aluminum silicate, aluminum phosphate, magnesium aluminate, magnesium hydroxide, magnesium carbonate, magnesium phosphate, etc.

Although the proportion of the metal compound to be used is not always limited, it is desirable to use usually 1 to 500 parts by weight, more desirably about 5 to about 300 parts by weight, of the compound per 100 parts by weight of the dye precursor.

As stated above, the color produced from the reaction of the dye precursor of the formula (1) and the color developer is almost limited to reddish purple to purple. However, when there is conjointly used in the above reaction at least one member selected from the group consisting of phenolic compounds of the formulae (10), (11) and (12) and phenolic resin having a partial structure of the formula (13), the color forming properties are further improved and the color can be changed to blue to dark blue, hence preferable when such color is desired.

The phenolic compound or phenolic resin resembles the coupler in the diazo coupling system or a cyan coupler for use in silver halide color photography, and must have within the molecule an active methine group which may have a removable group.

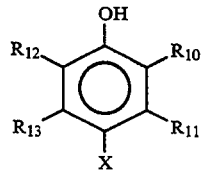

(10)

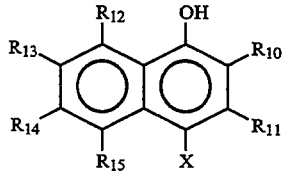

(11)

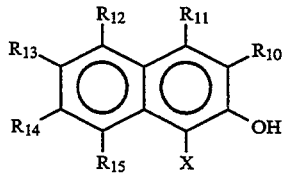

(12)

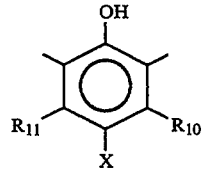

(13)

wherein $R_{10}$ to $R_{15}$ are each a hydrogen atom, halogen atom, hydroxyl, amino, alkyl, substituted alkyl, alkoxyl, substituted alkoxyl, aryl, substituted aryl, carbamoyl, substituted carbamoyl, sulfamoyl, substituted sulfamoyl, alkylcarbonylamino, substituted alkylcarbonylamino, arylcarbonylamino, substituted arylcarbonylamino, ureido, substituted ureido, aryloxycarbonyl, substituted aryloxycarbonyl, alkoxycarbonyl, substituted alkoxycarbonyl, alkylsulfonylamino, substituted alkylsulfonylamino, arylsulfonylamino, substituted arylsulfonylamino, alkylthio, substituted alkylthio, arylthio, substituted arylthio, aryloxy or substituted aryloxy, and X is a hydrogen atom or removable group.

Incidentally, some substituents are expressed by the same symbol in the formulae (10) to (13). This is merely intended to avoid repeated description of the substituents.

Among the phenolic compounds of the formulae (10), (11) and (12), and the phenolic resin having a partial structure of the formula (13), particularly preferable are the phenolic compounds of the formulae (10) and (11), and the phenolic resin having a partial structure of the formula (13).

In the formulae (10), (11), (12) and (13), examples of removable groups represented by X are halogen atoms, and alkoxyl, aryloxy, alkylthio, arylthio, etc. each of which may have a substituent.

Among the phenolic compounds of the formula (10) preferable are those in which one or two substituents represented by $R_{10} \sim R_{13}$ are ureido, N'-alkylureido, N'-phenylalkylureido, N'-phenylalkylureido having a substituent in the ring, N'-phenoxyalkylureido, N'-phenoxyalkylureido having a substituent in the ring, N'-phenylureido, N'-phenylureido having a substituent in the ring, alkylcarbonylamino, phenylalkylcarbonylamino, phenylalkylcarbonylamino having a substituent in the ring, phenoxyalkylcarbonylamino, phenoxyalkylcarbonylamino having a substituent in the ring, phenylcarbonylamino, phenylcarbonylamino having a substituent in the ring, and other substituents including X are hydrogen atoms.

In the above, an alkyl constituting N'-alkylureido and alkylcarbonylamino groups preferably has 1 to 20 carbon atoms. An alkyl which constitutes N'-phenylalkylureido, N'-phenoxyalkylureido, phenylalkylcarbonylamino and phenoxyalkylcarbonylamino groups is preferably a branched-chain or straight-chain alkylene having 1 to 6 carbon atoms. Further, a substituent in the ring is preferably $C_1 \sim C_5$ alkyl, $C_1 \sim C_4$ alkoxyl and halogen atom. Each phenyl group may have 1 to 5 substituents in the ring.

Among the phenolic compounds of the formulae (11) and (12) preferable are those in which one or two substituents represented by $R_{10} \sim R_{15}$ are carbamoyl, alkylcarbamoyl, phenylalkylcarbamoyl, phenylalkylcarbamoyl having a substituent in the ring, phenoxyalkylcarbamoyl, phenoxyalkylcarbamoyl having a substituent in the ring, phenylcarbamoyl, phenylcarbamoyl having a substituent in the ring, and other substituents including X are hydrogen atoms.

In the above, an alkyl constituting alkylcarbamoyl group preferably has 1 to 20 carbon atoms. An alkyl which constitutes phenylalkylcarbamoyl and phenoxyalkylcarbamoyl groups is preferably a branched-chain or straight-chain alkylene having 1 to 6 carbon atoms. Further, a substituent in the ring is preferably $C_1 \sim C_5$ alkyl, $C_1 \sim C_4$ alkoxyl and halogen atom. Each phenyl group may have 1 to 5 substituents in the ring.

Examples of useful phenolic compounds of the formula (10), (11) or (12) are as follows. Phenol, p-methoxyphenol, m-methoxyphenol, guaiacol, p-chlorophenol, o-chlorophenol, m-aminophenol, o-aminophenol, m-acetylaminophenol, m-benzoylaminophenol, resorcinol, catechol, pyrogallol, p-(methylthio)phenol, m-(methylthio)phenol, 2,5-dimethylphenol, 2-(4-hydroxyphenylthio)ethyl (4-hydroxyphenylthio)acetate, n-octyl gallate, n-propyl gallate, 4,4'-thiodiphenol, 4-(benzylthio)-phenol, 4-(phenylthio)phenol, 2-methylresorcinol, 4-chlororesorcinol, 4-(dodecylthio)catechol, 2,6-dimethoxyphenol, m-cresol, 4-methylthio-m-cresol, 2-acetylaminophenol, 2-propionylaminophenol, 2,4-dichloro-6-acetylaminophenol, 2,4-dichloro-3-methyl-6-acetylaminophenol, 2-phenoxyacetylamino-5-methylphenol, 2-phenoxyacetylaminophenol, 2-benzoylaminophenol, 2-phenylacetylaminophenol, 2-benzoylamino-1-naphthol, 8-benzoylamino-1-naphthol, 3-hydroxyphenylurea, 2-hydroxyphenylurea, 1,3-bis(3-hydroxyphenyl)urea, 2-(3-N-octylureido)phenol, 1,3-bis(2-hydroxyphenyl)urea, 2-(3-N-phenylureido)phenol, 2,5-diacetylaminophenol, 2,4-dichloro-3-methyl-6-phenoxyacetylaminophenol, 2-[2-(2,4-di-tert-pentylphenoxy)-butyrylamino]phenol, 2-acetylamino-5-(2-phenoxybutyrylamino)phenol, 2-acetylamino-5-[2-(2,4-di-tert-pentylphenoxy)butyrylamino]phenol, 2-acetylamino-5-phenoxyacetylaminophenol, 2,4-dichloro-3-methyl-6-[2-(2,4-di-tert-pentylphenoxy)butyrylamino]phenol, 2-(3-N-phenylureido)-5-[2-(2,4-di-tert-pentylphenoxy)-butyrylamino]phenol, 2-benzoylamino-5-phenoxyacetylaminophenol, 2-acetylamino-4-methoxyphenol, α-naphthol, β-naphthol, 1-hydroxy-2-naphthanilide, phenyl 1-hydroxy-2-naphthoate, 4-methoxy-1-naphthol, 4-chloro-1-naphthol, 2-hydroxy-3-naphthanilide, 4-phenylthio-1-naphthol, 4-(p-chlorophenylthio)-1-naphthol, 6-benzylthio-2-naphthol, 4-methylthio-1-naphthol, 4-benzylthio-1-naphthol, 4-n-octylthio-1-naphthol, 6-(p-chlorophenylthio)-2-naphthol, 6-bromo-2-naphthol, 2,3-dihydroxynaphthol, 6-dodecylthio-2-naphthol, 2-N-methylcarbamoyl-1-naphthol, 2-N-benzylcarbamoyl-1-naphthol, 2-N-[4-(2,4-di-tert-pentylphenoxy)butyl]carbamoyl-1-naphthol, 2-N-[4-(2,4-di-tert-pentylphenoxy)-butyl]carbamoyl-4-chloro-1-naphthol, 2-N-[3-(2,4-di-tert-pentylphenoxy)propyl]carbamoyl-1-naphthol, 2-N-(3-phenoxypropyl)carbamoyl-1-naphthol, 2-N-dodecylcarbamoyl-1-naphthol, 1-hydroxy-4-phenylthio-2-naphthanilide, 4-(2-carboxymethylthioethoxy)-2-N-phenylcarbamoyl-1-naphthol, 2-N-{3-N-[4-(2,4-di-tert-pentylphenoxy)butyl]sulfamoylphenyl}carbamoyl-1-naphthol, 2-N-(4-phenoxybutyl)carbamoyl-4-methoxy-1-naphthol, 3-N-(3-phenoxypropyl)carbamoyl-2-naphthol, 3-N-phenylcarbamoyl-6-benzylthio-2-naphthol, 2-N-phenylcarbamoyl-4-benzylthio-1-naphthol, etc.

Further, in the present invention, it is possible to use the phenolic resin having a partial structure of the formula (13) in place of the above phenolic compound. In the phenolic resin preferable are those in which $R_{10}$ and $R_{11}$ are each a hydrogen atom, $C_1 \sim C_4$ alkyl or $C_1 \sim C_4$ alkoxyl, X is a hydrogen atom, and a number of phenol nucleus is 2 to 20. Preferable is a phenolic resin which has a patial structure of the formula (13) in an amount of 50 to 100% based on the total phenol nucleus. Examples of the phenolic resins are linear oligomers such as 2,2'-dihydroxydiphenylmethane, 2,6-bis(2'-hydroxybenzyl)-phenol, compound of the formula (14) below, high-ortho novolak resin, etc., and cyclic oligomers such as calix[4]arene, calix[6]arene, calix[8]arene, etc.

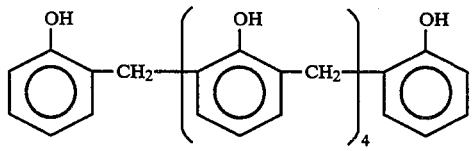

(14)

The phenolic compound and phenolic resin are not limited to those set fourth above and, as required, at least two of them are used.

Although the proportion of such a phenolic compound or phenolic resin to be used is not limited specifically, it is preferable to use generally 1 to 500 parts by weight, more preferably about 10 to about 300 parts by weight, of the compound or resin per 100 parts by weight of the dye precursor.

While the specific pyrazolone-derived leuco compound described is used as the dye precursor in the present invention, known basic dyes can also be used in combination with the precursor when so required insofar as they do not impair the desired effect of the present invention. Examples of such known basic dyes are as follows.

Triarylmethane-based dyes, e.g., 3,3-bis(p-dimethylaminophenyl)-6-dimethylaminophthalide, 3,3-bis(p-dimethylaminophenyl)phthalide, 3-(4-dimethylaminophenyl)-3-(4-diethylamino-2-methylphenyl)-6-(dimethylamino)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl- 3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Divinylphthalide-based dyes, e.g., 3,3-bis[1,1-bis(4-pyrrolidinophenyl)ethylene-2-yl]-4,5,6,7-tetrabromophthalide, 3,3-bis[1-(4-methoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methylnaphtho(6'-methoxybenzo)spiropyran, 3-propyl-spiro-dibenzopyran, etc.

Lactam-based dyes, e.g., rhodamine-B-anilinolactam, rhodamine(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-N-diethylaminofluoran, 4-benzylamino-8-diethylaminobenzo[a]fluoran, 3-[4-(4-dimethylaminoanilino)anilino]-7-chloro-6-methylfluoran, 8-[4-(4-dimethylaminoanilino)anilino]-benzo[a]-fluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dimethylamino-6-methyl-7-phenylaminofluoran, 3-di-n-butylamino-6-methyl-7-phenylaminofluoran, 3-di-n-pentylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-di-n-butylamino-7-(o-chlorophenylamino)fluoran, 3-(N-ethyl-N-n-hexylamino)-7-(o-chlorophenylamino)fluoran, 3-(N-ethyl-N-isoamylamino)-7-(o-chlorophenylamino)fluoran, 3-(N-ethyl-N-tetrahydrofurfurylamino)-6-methyl-7-phenylaminofluoran, 3-(N-methyl-N-n-propylamino)-6-methyl-7-phenylaminofluoran, 3-(N-ethyl-N-isobutylamino)-6-methyl-7-phenylaminofluoran, 3-(N-methyl-N-n-hexylamino)-6-methyl-7-phenylaminofluoran, 3-[N-(3-ethoxypropyl)-N-methylamino]-6-methyl-7-phenylaminofluoran, 3-[N-ethyl-N-(3-ethoxypropyl-)amino]-6-methyl-7-phenylaminofluoran, 3-diethylamino-7-[m-(trifluoromethyl)phenylamino]fluoran, 3-diethylamino-7-(o-fluorophenylamino)fluoran, 3-di-n-butylamino-7-(o-fluorophenylamino)fluoran, 3-diethylamino-6-chloro-7-phenylaminofluoran, 3-(N-ethyl-N-n-hexylamino)-6-methyl-7-phenylaminofluoran, 3-(N-ethyl-N-cyclopentylamino)-6-methyl-7-phenylaminofluoran, 2,2-bis{4-[6'-(N-cyclohexyl-N-methylamino)-3'-methylspiro(phthalide-3,9'-xanthene)-2'-ylamino]phenyl}propane, etc.

Fluorene-based dyes, e.g., 3,6-bis(dimethylamino)-fluorene-9-spiro-3'-(6'-dimethylamino)phthalide, 3-diethylamino-6-(N-allyl-N-methylamino)fluorene-9-spiro-3'-(6'-dimethylamino)phthalide, 3,6-bis(dimethylamino)-spiro-[fluorene-9,6'-6'H-chromeno(4,3-b)indole], 3,6-bis(dimethylamino)-3'-methyl-spiro[fluorene-9,6'-6'H-chromeno(4,3-b)indole], 3,6-bis(diethylamino)-3'-methyl-spiro[fluorene-9,6'-6'H-chromeno(4,3-b)indole], etc. These basic dyes are not limited to thereabove and can be used, as required, in a mixture of at least two of them.

In case of using the basic dye conjointly with the present dye precursor, it is desirable to use 0.2 to 20 parts by weight of the basic dye per 10 parts by weight of the dye precursor.

Further, in a heat sensitive recording material or the like, various heat-fusible substances can be used as a record sensitivity improving agent in order to obtain an excellent amenability to high-speed recording. Examples of useful heat-fusible substances are caproic acid amide, capric acid amide, palmitic acid amide, stearic acid amide, oleic acid amide, erucic acid amide, linoleic acid amide, linolenic acid amide, N-methylstearic acid amide, stearic acid anilide, N-methyloleic acid amide, benzanilide, linoleic acid anilide, N-ethylcapric acid amide, N-butyllauric acid amide, N-octadecylacetamide, N-oleylacetamide, N-oleylbenzamide, N-stearylcyclohexylamide, polyethylene glycol, 1-benzyloxynaphthalene, 2-benzyloxynaphthalene, 1-hydroxynaphthoic acid phenyl ester, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy-2-(4-methoxyphenoxy)ethane, 1-(2-methylphenoxy)-2-(4-methoxyphenoxy)ethane, dibenzyl terephthalate, dibenzyl oxalate, di(4-methylbenzyl)oxalate, benzyl p-benzyloxybenzoate, p-benzylbiphenyl, 1,5-bis(p-methoxyphenoxy)-3-oxapentane, 1,4-bis(2-vinyloxyethoxy)benzene, p-biphenyl p-tolyl ether, benzyl p-methylthiophenyl ether, 2,2'-methylenebis(4-methyl-6-tert-butylphenol), 2,2'-methylenebis(4-ethyl-6-tert-butylphenol), 4,4'-butylidenebis(6-tert-butyl-3-methylphenol), 1,1,3-tris(2-methyl-4-hydroxy-5-tert-butylphenyl)butane, 1,1,3-tris(5-cyclohexyl-4-hydroxy-2-methylpheny)butane, benzotriazole, 1-N-hydroxy-benzotriazole, 1-N-benzoyl-benzotriazole, 1-N-acetyl-benzotriazole, 2-(2'-hydroxy-5'-methylphenyl)benzotriazole, 2-(2'-hydroxy-3',5'-di-tert-butylphenyl)-5-chloro-benzotriazole, 2-(2'-hydroxy-3'-tert-butyl-5'-methylphenyl)-5-chlorobenzotriazole, 2-(2'-hydroxy-3',5'-di-tert-amylphenyl)benzotriazole, 2-(2'-hydroxy-3',5'-di-tert-butylphenyl)benzotriazole, 2-(2'-hydroxy-5'-tert-butylphenyl)benzotriazole, 2-(2'-hydroxy-5'-tert-octylphenyl)benzotriazole and 2-[2'-hydroxy-3',5'-bis($\alpha$,$\alpha$-dimethylbenzyl)phenyl]benzotriazole.

Although the proportion of such a heat-fusible substance to be used is not limited specifically, it is preferable to use generally 50 to 700 parts by weight, more preferably about 100 to about 500 parts by weight, of the substance per 100 parts by weight of the dye precursor.

A detailed description will be given below of typical recording materials which comprise a compound of the formula (1) serving as the dye precursor, an acidic substance serving as the color developer therefor, and as required at least one selected from the group consisting of phenolic compounds of the formulae (10), (11) and (12) and phenolic resin having a partial structure of the formula (13).

Pressure sensitive recording materials are available in various forms as disclosed, for example, in U.S. Pat. Nos. 2,505,470, 2,505,471, 2,505,489, 2,548,366, 2,712,507, 2,730,456, 2,730,457, 3,418,250, 3,924,027, 4,010,038, etc. The present invention is applicable to such pressure sensitive recording materials of various forms.

Generally, a color developer sheet (so-called under sheet) is prepared by dispersing at least one color developer of the invention in a binder, such as styrene-butadiene copolymer latex or polyvinyl alcohol, along with a pigment and optionally a phenolic compound or phenolic resin to obtain a color developer coating composition, and applying the composition to paper, plastics sheet, resin-coated paper or like suitable substrate.

On the other hand, a color former sheet (so-called top sheet) for use in combination with the color developer sheet is prepared by dissolving the dye precursor of the invention in a suitable solvent comprising a synthetic oil such as an alkylated naphthalene, alkylated diphenyl, alkylated diphenylmethane or alkylated terphenyl, vegetable oil such as cotton seed oil or castor oil, animal oil, mineral or mixture of such oils, dispersing the solution in a binder, or incorporating the solution into microcapsules by an encapsulation process such as coacervation process, interface polymerization process or in-situ process and dispersing the encapsulated solution in a binder, and applying the dispersion to paper, plastics sheet, resin-coated paper or like suitable substrate.

It is of course possible to prepare a so-called middle sheet by applying the color developer coating composition to one surface of a substrate and coating the other surface thereof with the dye dispersion or the dispersion of dye capsules, or to prepare a pressure sensitive manifold sheet of the self-contained type by coating one surface of a substrate with a composition containing dye capsules and the color developer, or with the dye capsule dispersion and further with the color developer composition so as to cause the substrate to support both the encapsulated dye and the color developer on the same surface.

The proportions of the dye precursor, color developer and the phenolic compound or phenolic resin optionally used are suitably determined in accordance with the desired amount of application, form of the pressure sensitive recording material, encapsulation process, formulation of the coating composition including various auxiliary agents and method of application since the proportions differ with these conditions.

Heat sensitive recording materials are available in various forms as disclosed, for example, in JP-B-3680/1969, -27880/1969, -14039/1970, -43830/1973, -69/1974, -70/1974, -20142/1977, etc. The color forming system of the present invention is applicable to such heat sensitive recording materials of various forms.

The heat sensitive recording materials of the invention is prepared generally by dispersing the dye precursor and color developer of the invention, and the phenolic compound or phenolic resin optionally used in a medium having a binder dissolved or dispersed therein to obtain a coating composition, and applying the composition to a suitable substrate such as paper, plastics film, synthetic paper, non-woven fabric sheet or molding.

Although the proportions of the dye precursor, color developer and the phenolic compound or phenolic resin optionally used in the recording layer are not limited specifically, the color developer is used generally in an amount of 50 to 700 parts by weight, preferably about 100 to about 500 parts by weight, per 100 parts by weight of the dye precursor. In case of using the phenolic compound or phenolic resin, the proportions thereof are not limited specifically, but the phenolic compound or phenolic resin is used generally in an amount of 1 to 500 parts by weight, preferably about 10 to about 300 parts by weight, per 100 parts by weight of the dye precursor. To give improved color forming ability, mat the surface of the recording layer and afford improved writability, inorganic pigments can be incorporated into the coating composition in an amount of 0.1 to 10 parts by weight, preferably about 0.5 to about 3 parts by weight, per part by weight of the color developer. Also suitably usable when required are various auxiliary agents such as dispersants, ultraviolet absorbers, heat-fusible substances, deforming agents, fluorescent dyes and coloring dyes.

As described above, the heat sensitive recording material of the present invention is prepared generally by coating a substrate with a composition having dispersed therein fine particles of dye precursor and color developer, whereas the substrate may alternatively be coated with superposed layers of two kinds of compositions having the dye precursor and color developer dispersed therein respectively. In case of conjointly using the phenolic compound or phenolic resin, the substrate may be coated with superposed layers of two kinds of compositions, one having the phenolic compound or phenolic resin and either one of the dye precursor or color developer dispersed therein, and the other having the color developer dispersed therein when the dye precursor is used in the above or having the the dye precursor dispersed therein when the color developer is used in the above. Alternatively, the substrate may be coated with superposed layers of three kinds of compositions having the dye precursor, color developer and phenolic compound or phenolic resin dispersed therein respectively. The material can of course be prepared by impregnation or the paper making process.

The method of preparing the coating composition, coating method, etc. are not limited specifically. The composition is applied generally in an amount of 2 to 12 $g/m^2$ calculated as dry weight. Further to protect the recording layer or give the layer improved writability, it is of course possible to form over the recording layer 0.2 to 10 $g/m^2$, preferably 0.5 to 5 $g/m^2$ (calculated as dry weight), of an overcoat layer, or to form an undercoat layer on the substrate. Thus various techniques known in the art of preparing heat sensitive recording materials can be additionally used suitably.

Examples of useful binders are starches, celluloses, proteins, gum arabic, polyvinyl alcohol, styrene-maleic anhydride copolymer salt, styrene-butadiene copolymer emulsion, vinyl acetate-maleic ahnydride copolymer salt, polyacrylic acid salt, etc. A suitable binder is selected for use. The binder is used in an amount of 5 to 40 wt. %, preferably about 10 to about 30 wt. %, based on the total solids content of the coating composition.

Electrothermal recording materials are prepared, for example, by a method disclosed in JP-A-11344/1974 or -48930/1975. Such a material of the present invention is prepared generally by dispersing an electrically conductive substance, the dye precursor and color developer of the invention, and the phenolic compound or phenolic resin optionally used in a suitable medium along with a binder to obtain a coating composition and applying the composition to paper or like suitable substrate, or by coating the substrate with an electrically conductive substance to form a conductive layer and applying to the layer a coating composition in the form of a dispersion of the dye precursor, color developer, phenolic compound or phenolic resin optionally used and a binder. If the dye precursor and color developer are not meltable in the preferred temperature range, for example, of 70° to 120°, a suitable heat-fusible substance is used in combination therewith, whereby the sensitivity to Joule heat is adjustable.

The recording materials of the invention thus prepared have excellent color forming properties and develop no color in the blank background area or retain recorded images free of color change or fading even when exposed to high temperatures or high humidities or brought into contact with chemicals, hence an outstanding quality.

The present invention will be described in greater detail with reference to the following examples, to which the invention is not limited, The parts and percentages in the examples are all by weight unless otherwise specified.

EXAMPLE 1

[Preparation of Color Former Sheet for Pressure Sensitive Recording Material]

Six parts of 1,3-diphenyl-4-(4-N,N-diethylaminophenylamino)-4-acetylamino-5-pyrazolone was dissolved in 100 parts of isopropylnaphthalene, and the solution was admixed with a solution of 25 parts of pig skin gelatin, 8 in isoelectric point, and 25 parts of gum arabic in 350 parts of hot water (50° C.) to obtain an emulsion. To the emulsion was added 1000 parts of hot water, the mixture was adjusted to a pH of 4 with acetic acid and then cooled to 10° C., and 10 parts of 25% aqueous solution of glutaraldehyde was added to the mixture to form cured capsules. The resulting capsule-containing coating composition was applied to one surface of a paper substrate weighing 45 g/m$^2$ in an amount of 5 g/m$^2$ calculated as dry weight to obtain a color former sheet.

[Preparation of Color Developer Sheet for Pressure Sensitive Recording Material]

On the other hand, 20 parts of zinc salt of 3,5-di(α-methylbenzyl)salicylic acid, 80 parts of kaolin and 30 parts of styrene-butadiene copolymer emulsion (50% in solids content) were dispersed in 200 parts of water to obtain a color developer coating composition, which was applied to a paper substrate weighing 45 g/m$^2$ in an amount of 5 g/m$^2$ calculated as dry weight to prepare a color developer sheet.

[Evaluation]

The color former sheet and the color developer sheet thus obtained were placed over each other with the capsule coating facing the color developer coating to prepare a pressure sensitive recording material. When the material was subjected to a writing pressure, purple images were formed which had a high density and was excellent in solvent resistance and light resistance.

EXAMPLES 2 AND 3

Two kinds of color developer sheets were prepared in the same manner as in Example 1 with the exception of using the following color developer in place of 20 parts of zinc salt of 3,5-di(α-methylbenzyl)salicylic acid used in preparing the color developer sheet of Example 1.

Example 2: 20 parts of zinc salt of 4-(3-p-tolylsulfonylpropoxy)salicylic acid

Example 3: 20 parts of zinc salt of 4-(2-p-methoxypheoxyethoxy)salicylic acid

The color developer sheets were used to prepare pressure sensitive recording materials. When checked for color formation in the same manner as in Example 1, these materials produced purple images, which had a high density and was excellent in solvent resistance and light resistance.

EXAMPLE 4

A color former sheet was prepared in the same manner as in Example 1 except that 1-phenyl-3-stearoylamino-4-(4-N,N-diethylaminophenylamino)-4-acetylamino-5-pyrazolone was used in place of 1,3-diphenyl-4-(4-N,N-diethylaminophenylamino)-4-acetylamino-5-pyrazolone.

The color former sheet was used to prepare a pressure sensitive recording material. When checked for color formation in the same manner as in Example 1, the material produced purple images, which had a high density and was excellent in solvent resistance and light resistance.

EXAMPLE 5

[Preparation of Color Developer Sheet for Pressure Sensitive Recording Material]

A 20-part quantity of zinc salt of 3,5-di(α-methylbenzyl)salicylic acid, 3 parts of 2-benzoylaminophenol, 80 parts of kaolin and 30 parts of styrene-butadiene copolymer emulsion (50% in solids content) were dispersed in 200 parts of water to obtain a color former coating composition, which was applied to a paper substrate weighing 45 g/m$^2$ in an amount of 5 g/m$^2$ calculated as dry weight to prepare a color developer sheet.

[Evaluation]

The color former sheet obtained in Example 1 and the above color developer sheet were placed over each other with the capsule coating facing the color developer coating to prepare a pressure sensitive recording material. When the material was subjected to a writing pressure, blue images were formed which had a high density and was excellent in solvent resistance and light resistance.

EXAMPLES 6 AND 7

Two kinds of color developer sheets were prepared in the same manner as in Example 5 with the exception of using the following phenolic compound in place of 3 parts of 2-benzoylaminophenol used in preparing the color developer sheet of Example 5.

Example 6: 3 parts of 2-acetylamino-5-[2-(2,4-di-tert-pentylphenoxy)butyrylamino]phenol Example 7: 3 parts of 2-N-[3-(2,4-di-tert-pentylphenoxy)propyl]carbamoyl-1-naphthol The color developer sheets were used to prepare pressure sensitive recording materials. When checked for color formation in the same manner as in Example 5, these materials produced blue images, which had a high density and was excellent in solvent resistance and light resistance.

EXAMPLE 8

The color former sheet obtained in Example 4 and the color developer sheet obtained in Example 5 were placed over each other with the capsule coating facing the color developer coating to prepare a pressure sensitive recording material. When the material was subjected to a writing pressure, blue images were formed which had a high density and was excellent in solvent resistance and light resistance.

EXAMPLE 9

[Preparation of Heat Sensitive Recording Material]

(1) Preparation of Composition A

| | |
|---|---|
| 1-Phenyl-3-methyl-4-(4-N,N-diethylamino-phenylamino)-4-acetylamino-5-pyrazolone | 10 parts |
| | 10 parts |
| Water | 20 parts |

The above composition was pulverized by a sand mill to a mean particle size of 1.5 μm.

(2) Preparation of Composition B

| | |
|---|---|
| 1,2-Bis(3-methylphenoxy)ethane | 30 parts |
| 5% Aqueous solution of methyl cellulose | 30 parts |
| Water | 60 parts |

The above composition was pulverized by a sand mill to a mean particle size of 1.5 μm.

(3) Preparation of Composition C

| | |
|---|---|
| Zinc salt of α-naphthoic acid | 30 parts |
| 5% Aqueous solution of methyl cellulose | 30 parts |
| Water | 90 parts |

This composition was pulverized by a sand mill to a mean particle size of 1.5 μm.

(4) Formation of Recording Layer

A coating composition was prepared from 40 parts of composition A, 120 parts of composition B, 150 parts of composition C, 10 parts of silicon oxide pigment (180 ml/100 g in oil absorption), 75 parts of 20% aqueous solution of oxidized starch and 80 parts of water by mixing these ingredients together with stirring. The composition obtained was applied to a paper substrate weighing 50 g/m$^2$ in an amount of 6.0 g/m$^2$ calculated as dry weight, then dried and treated by a supercalender to obtain a heat sensitive recording paper.

EXAMPLES 10 TO 25

Sixteen kinds of heat sensitive recording papers were prepared in the same manner as in Example 9 with the exception of using the following compound in place of the 1-phenyl-3-methyl-4-(4-N,N-diethylamino-phenylamino)-4-acetylamino-5-pyrazolone used in preparing composition A of Example 9.

Example 10: 1,3-diphenyl-4-(4-N,N-diethylamino-phenylamino)-4-acetylamino-5-pyrazolone Example 11: 1-phenyl-3-benzoylamino-4-(4-N,N-diethylaminophenylamino)-4-acetylamino-5-pyrazolone Example 12: 1-phenyl-3-methyl-4-(4-N,N-dimethylaminophenylamino)-4-acetylamino-5-pyrazolone Example 13: 1-phenyl-3-methyl-4-(4-N,N-diethylaminophenylamino)-4-benzoylamino-5-pyrazolone Example 14: 1-(2,4,6-trichlorophenyl)-3-benzoylamino-4-(4-N,N-diethylaminophenylamino)-4-acetylamino-5-pyrazolone Example 15: 1-phenyl-3-[4-(3-p-tolylsulfonylpropoxy)benzoylamino]-4-(4-N,N-diethylamino-phenylamino)-4-acetylamino-5-pyrazolone Example 16: 1-phenyl-3-[4-(2-p-methoxyphenoxyethoxy)benzoylamino]-4-(4-N,N-diethylamino-phenylamino)-4-acetylamino-5-pyrazolone Example 17: 1-phenyl-3-benzoylamino-4-[4-N-ethyl-N-(2-hydroxyethyl)aminophenylamino]-4-acetylamino-5-pyrazolone Example 18: 1-phenyl-3-phenylacetylamino-4-(4-N,N-diethylaminophenylamino)-4-acetylamino-5-pyrazolone Example 19: 1-phenyl-3-(2-chloroanilino)-4-(4-N,N-diethylaminophenylamino)-4-acetylamino-5-pyrazolone Example 20: 1-phenyl-3-[4-(3-p-tolylsulfonylpropoxy)benzoylamino]-4-[4-N-ethyl-N-(2-hydroxyethyl-)aminophenylamino]-4-acetylamino-5-pyrazolone Example 21: 1-phenyl-3-benzoylamino-4-(4-N,N-diethylaminophenylamino)-4-benzoylamino-5-pyrazolone Example 22: 1-phenyl-3-(4-methoxybenzoylamino)-4-(4-N,N-diethylaminophenylamino)-4-acetylamino-5-pyrazolone Example 23: 1-phenyl-3-benzoylamino-4-(4-N,N-diethylamino-2-methoxyphenylamino)-4-acetylamino-5-pyrazolone Example 24: 1-phenyl-3-phenoxyacetylamino-4-(4-N,N-diethylaminophenylamino)-4-acetylamino-5-pyrazolone Example 25: 1-phenyl-3-[3-(phenoxyacetylamino)-benzoylamino]-4-(4-N,N-diethylamino-phenylamino)-4-acetylamino-5-pyrazolone

EXAMPLES 26 TO 33

Eight kinds of heat sensitive recording papers were prepared in the same manner as in Example 11 with the exception of using the following compound in place of the zinc salt of α-naphthoic acid used for preparing composition C of Example 11.

Example 26: zinc salt of 4-(3-p-tolylsulfonylpropoxy)-salicylic acid

Example 27: zinc salt of 5-[p-(2-p-methoxyphenoxyethoxy)cumyl]salicylic acid

Example 28: zinc salt of 3,5-di(α,α-dimethylbenzyl)-salicylic acid

Example 29: zinc salt of 4-nitrobenzoic acid

Example 30: zinc salt of 4-chlorobenzoic acid

Example 31: zinc salt of 4-trifluoromethylbenzoic acid

Example 32: zinc salt of 4-(2-p-methoxyphenoxyethoxy)salicylic acid

Example 33: zinc salt of phenylacetic acid

EXAMPLE 34

A heat sensitive recording paper was prepared in the same manner as in Example 11 with the exception of using composition D given below in place of composition C of Example 11.

(1) Preparation of Composition D

| | |
|---|---|
| α-Naphthoic acid | 30 parts |
| Zinc oxide | 10 parts |
| 5% Aqueous solution of methyl cellulose | 60 parts |
| Water | 30 parts |

This composition was pulverized by a sand mill to a mean particle size of 1.5 μm.

EXAMPLES 35 AND 41

Seven kinds of heat sensitive recording papers were prepared in the same manner as in Example 34 with the exception of using the following compound in place of α-naphthoic acid used for preparing composition D of Example 34.

Example 35: 4-(3-p-tolylsulfonylpropoxy)salicylic acid

Example 36: 4-(2-p-methoxyphenoxyethoxy)salicylic acid

Example 37: 4-nitrobenzoic acid

Example 38: 4-chlorobenzoic acid

Example 39: 4-trifluoromethylbenzoic acid

Example 40: 5-[p-(2-p-methoxyphenoxyethoxy)-cumyl]salicylic acid

Example 41: 3,5-di(α,α-dimethylbenzyl)salicylic acid

EXAMPLES 42 TO 44

Three kinds of heat sensitive recording papers were prepared in the same manner as in Example 11 with the exception of using the following compound in place of the zinc salt of α-naphthoic acid used for preparing composition C of Example 11.

Example 42: 4,4'-isopropylidenediphenol

Example 43: 4-hydroxy-4'-isopropoxydiphenylsulfone

Example 44: complex of zinc thiocyanate with antipyrine.

Comparative Example 1

A heat sensitive recording paper was prepared in the same manner as in Example 11 except that 1,3-diphenylguanidine was used in place of the zinc salt of α-naphthoic acid used for preparing composition C of Example 11.

Comparative Example 2

A heat sensitive recording material was prepared in the same manner as in Example 9 with the exception of using 3-di-n-butylamino-6-methyl-7-phenylaminofluoran in place of the 1-phenyl-3-methyl-4-(4-N,N-diethylaminophenylamino)-4-acetylamino-5-pyrazolone used in preparing composition A of Example 9, and using 4,4'-isopropylidenediphenol in place of the zinc salt of α-naphthoic acid used for preparing composition C of Example 9.

The heat sensitive recording papers prepared in Examples 9 to 44 and Comparative Examples 1 and 2 were used on a thermal facsimile device (HITACHI LTD., HIFAX-700 Model) for recording, and the color density of recorded images was measured by a Macbeth densitometer (Macbeth Corp., Model RD-914). Table 1 shows the results with color of the recorded image.

Samples of the heat sensitive recording papers used for recording were allowed to stand in an atmosphere at 40° C. and R.H. of 90% for 24 hours and thereafter checked for resistance to moisture and heat. Like samples were allowed to stand at 20° C. for 24 hours with a polyvinyl chloride film placed over each sample and thereafter checked for resistance to plasticizer, or with ethanol applied to the color bearing surface of each sample and then checked for resistance to ethanol. Like samples were also exposed directly to sunlight for 24 hours and then checked for resistance to light. To determine the resistances, the resulting samples were evaluated with respect to the fogging of the background area and fading of the recorded image. Table 1 shows the results.

Criteria of evaluation

⊙: very excellent

: excellent

Δ: slightly poor and practically inapplicable depending on the quality desired x: poor and practically unsuitable

TABLE 1

| | color density | color | moisture and heat resistance | | plasticizer resistance | | alcohol resistance | | light resistance | |
|---|---|---|---|---|---|---|---|---|---|---|
| | | | fogging | fading | fogging | fading | fogging | fading | fogging | fading |
| Ex. 9 | 1.25 | reddish purple | ○ | ○ | ○ | ○ | Δ | ○ | Δ | ○ |
| Ex. 10 | 1.21 | purple | ○ | ○ | ○ | ○ | ○ | ○ | ○ | ○ |
| Ex. 11 | 1.24 | reddish purple | ⊙ | ○ | ⊙ | ○ | ○ | ○ | ⊙ | ⊙ |
| Ex. 12 | 1.25 | reddish purple | ○ | ○ | ○ | ○ | Δ | ○ | Δ | ○ |
| Ex. 13 | 1.21 | reddish purple | ○ | ○ | ○ | ○ | ○ | ○ | ○ | ○ |
| Ex. 14 | 1.21 | reddish purple | ⊙ | ○ | ⊙ | ○ | ○ | ○ | ⊙ | ⊙ |
| Ex. 15 | 1.23 | reddish purple | ⊙ | ⊙ | ⊙ | ⊙ | ⊙ | ⊙ | ⊙ | ⊙ |
| Ex. 16 | 1.22 | reddish purple | ⊙ | ○ | ⊙ | ⊙ | ⊙ | ⊙ | ⊙ | ⊙ |
| Ex. 17 | 1.28 | reddish purple | ⊙ | ⊙ | ⊙ | ⊙ | ○ | ○ | ⊙ | ⊙ |
| Ex. 18 | 1.28 | reddish purple | ○ | ⊙ | ⊙ | ⊙ | ⊙ | ⊙ | ⊙ | ⊙ |
| Ex. 19 | 1.20 | reddish purple | ○ | ○ | ○ | ○ | ○ | ○ | ○ | ⊙ |
| Ex. 20 | 1.25 | reddish purple | ⊙ | ⊙ | ⊙ | ⊙ | ⊙ | ⊙ | ⊙ | ⊙ |
| Ex. 21 | 1.20 | reddish purple | ⊙ | ⊙ | ⊙ | ○ | ○ | ○ | ⊙ | ⊙ |
| Ex. 22 | 1.23 | reddish purple | ⊙ | ○ | ⊙ | ○ | ○ | ○ | ⊙ | ⊙ |
| Ex. 23 | 1.20 | reddish purple | ⊙ | ○ | ⊙ | ○ | ○ | ○ | ⊙ | ⊙ |
| Ex. 24 | 1.25 | reddish purple | ○ | ○ | ⊙ | ○ | ○ | ○ | ○ | ⊙ |
| Ex. 25 | 1.20 | reddish purple | ⊙ | ○ | ⊙ | ○ | ○ | ○ | ⊙ | ⊙ |
| Ex. 26 | 1.20 | reddish purple | ⊙ | ⊙ | ⊙ | ⊙ | ○ | ○ | ⊙ | ⊙ |
| Ex. 27 | 1.23 | reddish purple | ⊙ | ⊙ | ⊙ | ⊙ | ○ | ○ | ⊙ | ⊙ |
| Ex. 27 | 1.24 | reddish purple | ⊙ | ○ | ○ | ○ | ○ | ○ | ○ | ⊙ |
| Ex. 29 | 1.27 | reddish purple | ⊙ | ○ | ⊙ | ○ | ○ | ○ | ○ | ⊙ |
| Ex. 30 | 1.24 | reddish purple | ⊙ | ○ | ⊙ | ○ | ○ | ○ | ○ | ⊙ |
| Ex. 31 | 1.30 | reddish purple | ⊙ | ⊙ | ○ | ○ | ○ | ○ | ○ | ⊙ |
| Ex. 32 | 1.22 | reddish purple | ⊙ | ⊙ | ○ | ○ | ⊙ | ○ | ⊙ | ⊙ |
| Ex. 33 | 1.14 | reddish purple | ○ | ○ | ○ | ○ | ○ | Δ | ○ | ⊙ |
| Ex. 34 | 1.28 | reddish purple | ⊙ | ⊙ | ⊙ | ○ | ○ | ○ | ⊙ | ⊙ |

TABLE 1-continued

| | color density | color | moisture and heat resistance fogging | moisture and heat resistance fading | plasticizer resistance fogging | plasticizer resistance fading | alcohol resistance fogging | alcohol resistance fading | light resistance fogging | light resistance fading |
|---|---|---|---|---|---|---|---|---|---|---|
| Ex. 35 | 1.23 | reddish purple | ◎ | ◎ | ◎ | ◎ | ○ | ◎ | ◎ | ◎ |
| Ex. 36 | 1.25 | reddish purple | ◎ | ○ | ◎ | ◎ | ○ | ○ | ◎ | ◎ |
| Ex. 37 | 1.30 | reddish purple | ◎ | ○ | ◎ | ○ | ○ | ○ | ○ | ◎ |
| Ex. 38 | 1.28 | reddish purple | ◎ | ○ | ◎ | ○ | ○ | ○ | ○ | ◎ |
| Ex. 39 | 1.31 | reddish purple | ◎ | ◎ | ○ | ○ | ○ | ○ | ○ | ◎ |
| Ex. 40 | 1.26 | reddish purple | ◎ | ◎ | ◎ | ◎ | ○ | ○ | ◎ | ◎ |
| Ex. 41 | 1.27 | reddish purple | ◎ | ○ | ○ | ○ | ○ | ○ | ○ | ◎ |
| Ex. 42 | 1.04 | reddish purple | ○ | ○ | Δ | Δ | Δ | Δ | Δ | ○ |
| Ex. 43 | 1.01 | reddish purple | ○ | ○ | Δ | Δ | Δ | Δ | Δ | ○ |
| Ex. 44 | 1.18 | reddish purple | ○ | ∘ | ○ | Δ | ○ | Δ | ○ | ◎ |
| Com. Ex. 1 | 0.35 | reddish purple | X | Δ | X | X | X | X | X | Δ |
| Com. Ex. 2 | 1.25 | black | ○ | Δ | ○ | X | X | X | X | Δ |

EXAMPLE 45

[Preparation of Heat Sensitive Recording Material]

(1) Preparation of Composition E

| | |
|---|---|
| 1-Phenyl-3-benzoylamino-4-(4-N,N-diethylamino-phenylamino)-4-acetylamino-5-pyrazolone | 10 parts |
| 5% Aqueous solution of methyl cellulose | 10 parts |
| Water | 20 parts |

The above composition was pulverized by a sand mill to a mean particle size of 1.5 μm.

(2) Preparation of Composition F

| | |
|---|---|
| 1,2-Bis(3-methylphenoxy)ethane | 30 parts |
| 5% Aqueous solution of methyl cellulose | 30 parts |
| Water | 60 parts |

The above composition was pulverized by a sand mill to a mean particle size of 1.5 μm.

(3) Preparation of Composition G

| | |
|---|---|
| Zinc salt of α-naphthoic acid | 30 parts |
| 5% Aqueous solution of methyl cellulose | 30 parts |
| Water | 90 parts |

This composition was pulverized by a sand mill to a mean particle size of 1.5 μm.

(4) Preparation of Composition H

| | |
|---|---|
| 2-Acetylaminophenol | 5 parts |
| 5% Aqueous solution of methyl cellulose | 5 parts |
| Water | 10 parts |

This composition was pulverized by a sand mill to a mean particle size of 1.5 μm.

(5) Formation of Recording Layer

A coating composition was prepared from 40 parts of composition E, 120 parts of composition F, 150 parts of composition G, 20 parts of composition H, 10 parts of silicon oxide pigment (180 ml/100 g in oil absorption), 75 parts of 20% aqueous solution of oxidized starch and 85 parts of water by mixing these ingredients together with stirring. The composition obtained was applied to a paper substrate weighing 50 g/m$^2$ in an amount of 6.0 g/m$^2$ calculated as dry weight, then dried and treated by a supercalender to obtain a heat sensitive recording paper.

EXAMPLES 46 TO 57

Twelve kinds of heat sensitive recording papers were prepared in the same manner as in Example 45 with the exception of using the following compound in place of the 2-acetylaminophenol used in preparing composition H of Example 45.

Example 46: 1-hydroxy-2-naphthanilide

Example 47: 2-(3-N-phenylureido)phenol

Example 48: 2-N-(3-phenoxypropyl)carbamoyl-1-naphthol

Example 49: 2-phenoxyacetylaminophenol

Example 50: phenol resin of the formula below

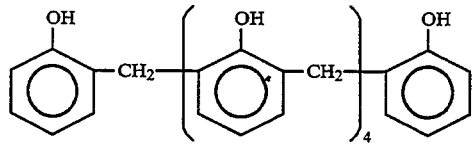

Example 51: calix[6]arene

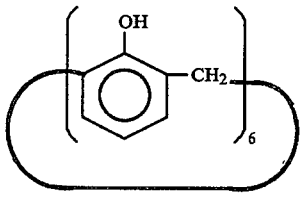

Example 52: 4-(2-carboxymethylthioethoxy)-2-N-phenylcarbamoyl-1-naphthol

Example 53: 2-benzoylamino-1-naphthol

Example 54: 8-benzoylamino-1-naphthol

Example 55: 2-N-methylcarbamoyl-1-naphthol

Example 56: 2-N-benzylcarbamoyl-1-naphthol

Example 57: 2-(phenylacetylamino)phenol

EXAMPLES 58 AND 63

Six kinds of heat sensitive recording papers were prepared in the same manner as in Example 45 with the exception of using the following compound in place of the 1-phenyl-3-benzoylamino-4-(4-N,N-diethylamino-phenylamino)-4-acetylamino-5-pyrazolone used in preparing composition E of Example 45.

Example 58: 1-phenyl-3-[4-(3-p-tolylsulfonylpropoxy)benzoylamino]-4-(4-N,N-diethylamino-phenylamino)-4-acetylamino-5-pyrazolone Example 59: 1-phenyl-3-[4-(2-phenoxyethoxy)benzoylamino]-4-(4-N,N-diethylaminophenylamino)-4-acetylamino-5-pyrazolone Example 60: 1-phenyl-3-benzoylamino-4-[4-N-ethyl-N-(2-hydroxyethyl)aminophenylamino]-4-acetylamino-5-pyrazolone Example 61: 1-phenyl-3-[4-(3-p-tolylsulfonylpropoxy)benzoylamino]-4-[4-N-ethyl-N-(2-hydroxyethyl-)aminophenylamino]-4-acetylamino-5-pyrazolone Example 62: 1-phenyl-3-phenylacetylamino-4-[4-N,N-diethylaminophenylamino]-4-acetylamino-5-pyrazolone Example 63: 1-phenyl-3- (2-chloroanilino)-4-(4-N,N-diethylaminophenylamino)-4-acetylamino-5-pyrazolone

EXAMPLES 64 TO 71

Eight kinds of heat sensitive recording papers were prepared in the same manner as in Example 45 with the exception of using the following compound in place of the zinc salt of α-naphthoic acid used for preparing composition G of Example 45.

Example 64: zinc salt of 4-(3-p-tolylsulfonylpropoxy)-salicylic acid

Example 65: zinc salt of 4-(2-p-methoxyphenoxyethoxy)salicylic acid

Example 66: zinc salt of 5-[p-(2-p-methoxyphenoxyethoxy)cumyl]salicylic acid

Example 67: zinc salt of 3,5-di(α,α-dimethylbenzyl)-salicylic acid

Example 68: zinc salt of 4-nitrobenzoic acid

Example 69: zinc salt of 4-chlorobenzoic acid

Example 70: zinc salt of 4-trifluoromethylbenzoic acid

Example 71: zinc salt of phenylacetic acid

EXAMPLE 72

A heat sensitive recording paper was prepared in the same manner as in Example 45 with the exception of using composition I given below in place of composition G of Example 45.

(1) Preparation of Composition I

| | |
|---|---|
| α-Naphthoic acid | 30 parts |
| Zinc oxide | 10 parts |
| 5% Aqueous solution of methyl cellulose | 60 parts |
| Water | 50 parts |

This composition was pulverized by a sand mill to a mean particle size of 1.5 μm.

EXAMPLE 73

A heat sensitive recording paper was prepared in the same manner as in Example 72 with the exception of using 5-[p-(2-p-methoxyphenoxyethoxy)cumyl]salicylic acid in place of the α-naphthoic acid used for preparing composition I in Example 72.

The heat sensitive recording papers prepared in Examples 45 to 73 were used on a thermal facsimile device (HITACHI LTD., HIFAX-700 Model) for recording, and the color density of recorded images was measured by a Macbeth densitometer (Macbeth Corp., Model RD-914). Table 2 shows the results with color of the recorded image.

Samples of the heat sensitive recording papers used for recording were allowed to stand in an atmosphere at 50° C. and R.H. of 90% for 24 hours and thereafter checked for resistance to moisture and heat. Like samples were allowed to stand at 40° C. for 24 hours with a polyvinyl chloride film placed over each sample and thereafter checked for resistance to plasticizer, or allowed to stand at 20° C. for 24 hours with ethanol applied to the color bearing surface of each sample and then checked for resistance to ethanol. Like samples were also exposed directly to sunlight for 24 hours and then checked for resistance to light. To determine the resistances, the resulting samples were evaluated with respect to the fogging of the background area and fading of the recorded image. Table 2 shows the results.

Criteria of evaluation

◎: very excellent

: excellent

Δ: slightly poor and practically inapplicable depeding on the quality desired x: poor and practically unsuitable

TABLE 2

| | color | | moisture and heat resistance | | plasticizer resistance | | alcohol resistance | | light resistance | |
|---|---|---|---|---|---|---|---|---|---|---|
| | density | color | fogging | fading | fogging | fading | fogging | fading | fogging | fading |
| Ex. 45 | 1.28 | blue | ◎ | ○ | ○ | ○ | ○ | ○ | ◎ | ◎ |
| Ex. 46 | 1.30 | dark blue | ◎ | ○ | ◎ | ○ | ◎ | ○ | ◎ | ◎ |
| Ex. 47 | 1.27 | blue | ◎ | ◎ | ◎ | ◎ | ◎ | ○ | ◎ | ◎ |
| Ex. 48 | 1.32 | dark blue | ◎ | ○ | ○ | ○ | ◎ | ○ | ○ | ◎ |
| Ex. 49 | 1.31 | blue | ◎ | ○ | ○ | ○ | ○ | ○ | ◎ | ◎ |
| Ex. 50 | 1.35 | blue | ◎ | ◎ | ◎ | ◎ | ◎ | ○ | ○ | ◎ |
| Ex. 51 | 1.27 | blue | ◎ | ◎ | ◎ | ◎ | ○ | ◎ | ◎ | ◎ |
| Ex. 52 | 1.24 | bluish purple | ◎ | ○ | ○ | ○ | ○ | Δ | ◎ | ◎ |
| Ex. 53 | 1.24 | blue | ○ | ○ | Δ | Δ | ○ | ○ | ○ | ◎ |
| Ex. 54 | 1.23 | blue | ○ | ○ | Δ | Δ | ○ | ○ | ○ | ◎ |
| Ex. 55 | 1.30 | dark blue | ○ | ○ | ○ | ○ | ◎ | ○ | ◎ | ◎ |
| Ex. 56 | 1.33 | dark blue | ○ | ○ | ○ | ○ | ○ | ○ | ○ | ◎ |
| Ex. 57 | 1.32 | blue | ◎ | ○ | ○ | ○ | ○ | ○ | ◎ | ◎ |
| Ex. 58 | 1.27 | blue | ◎ | ○ | ◎ | ◎ | ◎ | ○ | ◎ | ◎ |
| Ex. 59 | 1.25 | blue | ◎ | ○ | ○ | ◎ | ○ | ○ | ○ | ◎ |
| Ex. 60 | 1.34 | blue | ◎ | ◎ | ◎ | ◎ | ○ | ○ | ◎ | ◎ |
| Ex. 61 | 1.29 | blue | ◎ | ◎ | ◎ | ◎ | ◎ | ○ | ◎ | ◎ |
| Ex. 62 | 1.27 | blue | ○ | ○ | ○ | ◎ | ○ | ○ | ○ | ◎ |
| Ex. 63 | 1.22 | blue | ○ | ○ | ○ | ○ | ○ | ○ | ○ | ◎ |
| Ex. 64 | 1.27 | blue | ◎ | ◎ | ◎ | ◎ | ○ | ○ | ◎ | ◎ |
| Ex. 65 | 1.26 | blue | ◎ | ◎ | ◎ | ○ | ◎ | ○ | ◎ | ◎ |
| Ex. 66 | 1.25 | blue | ◎ | ○ | ◎ | ○ | ○ | ○ | ◎ | ◎ |
| Ex. 67 | 1.25 | blue | ○ | ○ | ○ | ◎ | ○ | ◎ | ○ | ◎ |
| Ex. 68 | 1.32 | dark blue | ◎ | ○ | ○ | ○ | ○ | ○ | ○ | ◎ |

TABLE 2-continued

| | color density | color | moisture and heat resistance fogging | moisture and heat resistance fading | plasticizer resistance fogging | plasticizer resistance fading | alcohol resistance fogging | alcohol resistance fading | light resistance fogging | light resistance fading |
|---|---|---|---|---|---|---|---|---|---|---|
| Ex. 69 | 1.28 | blue | ◎ | ○ | ○ | ○ | ○ | ○ | ○ | ◎ |
| Ex. 70 | 1.35 | dark blue | ○ | ◎ | ○ | ○ | ○ | ○ | ○ | ◎ |
| Ex. 71 | 1.18 | blue | ○ | ○ | ○ | ○ | ○ | Δ | ○ | ◎ |
| Ex. 72 | 1.32 | blue | ◎ | ◎ | ◎ | ◎ | ○ | ○ | ◎ | ◎ |
| Ex. 73 | 1.30 | blue | ◎ | ◎ | ◎ | ◎ | ○ | ○ | ◎ | ◎ |

The results given above reveal that the recording materials of the invention were excellent in the moisture and heat resistance, chemical resistance and light resistance of the recorded images and background area, and also satisfactory in color forming properties.

We claim:

1. A recording material utilizing a reaction between a colorless or light-colored dye precursor and a color developer capable of forming a color upon coming into contact with the dye precursor, the recording material being characterized in that the material comprises at least one pyrazalone compound serving as the dye precursor and represented by the formula (1), and at least one compound selected from the group consisting of an aromatic carboxylic acid and a polyvalent metal salt thereof serving as the color developer (1)

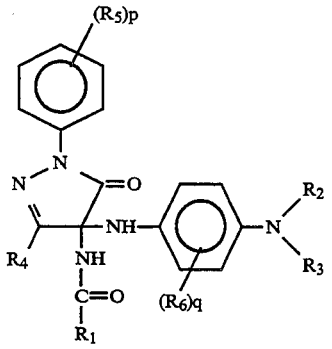

wherein $R_1$ is alkyl, alkoxyalkyl, aryl or aryl having a substituent, $R_2$ and $R_3$ are each alkyl, alkyl having a substituent, aryl or aryl having a substituent, $R_4$ is alkyl, alkyl having a substituent, aryl, aryl having a substituent, amino or amino having a substituent, $R_5$ and $R_6$ are each alkyl, alkoxyl or a halogen atom, p is 0 or an integer of 1 to 5, and q is 0 or an integer of 1 to 4.

2. A recording material as defined in claim 1 wherein said color developer compound is used in combination with at least one metal compound.

3. A recording material as defined in claim 1 wherein the aromatic carboxylic acid is a salicylic acid derivative of the formula (2) or (3)

(2)

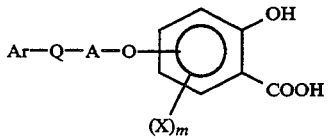

-continued (3)

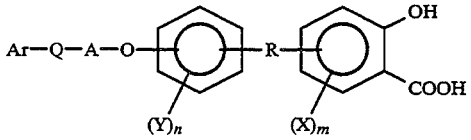

wherein Ar is phenyl, substituted phenyl, naphthyl, substituted naphthyl, aromatic heterocyclic group or substituted aromatic heterocyclic group, Q is an ether linkage or sulfonyl linkage, A is branched or straight-chain alkylene, branched or straight-chain alkylene having an ether linkage, ester linkage, amide linkage or unsaturated bond, cycloalkylene, cycloalkylene having an ether linkage, ester linkage or amide linkage, aralkylene, aralkylene having an ether linkage, ester linkage or amide linkage, or arylene, R is branched or unbranched alkylene, X is a hydrogen atom, alkyl, cycloalkyl, alkenyl, aralkyl, aryl, alkoxyl, aryloxy, nitro or halogen atom, Y is a hydrogen atom, alkyl, alkenyl, aralkyl or halogen atom, m is an integer of 1 to 3, and n is an integer of 1 to 4.

4. A recording material as defined in claim 1 wherein, in the formula (1), $R_1$ is $C_1 \sim C_4$ alkyl or phenyl, $R_2$ and $R_3$ are each $C_1 \sim C_4$ alkyl, or $C_1 \sim C_4$ alkyl substituted by $C_1 \sim C_4$ alkoxyl, hydroxyl or $C_1 \sim C_4$ alkylsulfonylamino, $R_4$ is arylcarbonylamino of the formula (4), (5) or (6) or alkylcarbonylamino of the formula (7), (8) or (9), $R_5$ is $C_1 \sim C_4$ alkyl, $C_1 \sim C_4$ alkoxyl or halogen atom and $R_6$ is $C_1 \sim C_4$ alkyl or $C_1 \sim C_4$ alkoxyl, p is 0 or an integer of 1 to 5, q is 0 or an integer of 1 to 4.

(4)

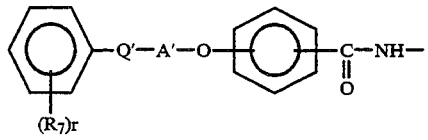

(5)

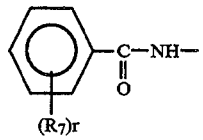

(6)

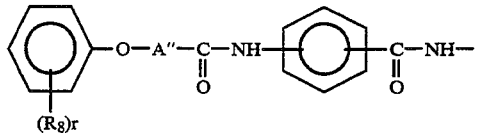

(7)

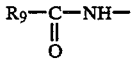

-continued (8)

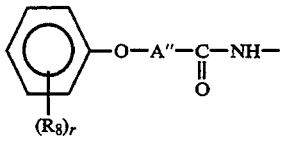

(9)

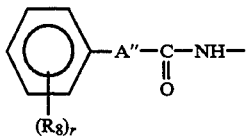

wherein $R_7$ is $C_1 \sim C_4$ alkyl, $C_1 \sim C_4$ alkoxyl or halogen atom, $R_8$ is $C_1 \sim C_5$ alkyl, $C_1 \sim C_4$ alkoxyl or halogen atom, $R_9$ is $C_1 \sim C_{25}$ alkyl, Q' is an ether linkage or sulfonyl linkage, A' is branched-chain or straight-chain $C_2 \sim C_6$ alkylene, A'' is branched-chain or straight-chain $C_1 \sim C_6$ alkylene, r is 0 or an integer of 1 to 5.

5. A recording material as defined in claim 4 wherein, in the formula (1), $R_4$ is arylcarbonylamino of the formula (4) or (5).

6. A recording material as defined in claim 1 further comprising at least one member selected from the group consisting of phenolic compounds of the formulae (10), (11) and (12) and phenolic resin having a partial structure of the formula (13) is used.

(10)

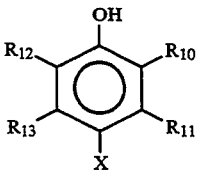

-continued (11)

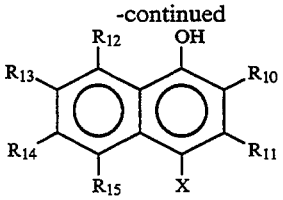

(12)

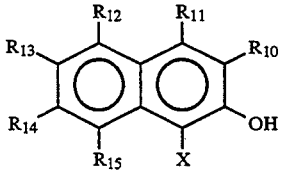

(13)

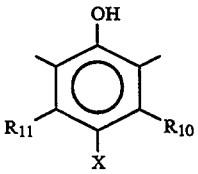

wherein $R_{10}$ to $R_{15}$ are each a hydrogen atom, halogen atom, hydroxyl, amino, alkyl, substituted alkyl, alkoxyl, substituted alkoxyl, aryl, substituted aryl, carbamoyl, substituted carbamoyl, sulfamoyl, substituted sulfamoyl, alkylcarbonylamino, substituted alkylcarbonylamino, arylcarbonylamino, substituted arylcarbonylamino, ureido, substituted ureido, aryloxycarbonyl, substituted aryloxycarbonyl, alkoxycarbonyl, substituted alkoxycarbonyl, alkylsulfonylamino, substituted alkylsulfonylamino, arylsulfonylamino, substituted arylsulfonylamino, alkylthio, substituted alkylthio, arylthio, substituted arylthio, aryloxy or substituted aryloxy, and X is a hydrogen atom or removable group.

7. A recording material as defined in claim 1 which is a heat sensitive recording material.

8. A recording material as defined in claim 1 which is a pressure sensitive recording material.

* * * * *